US010311784B2

(12) United States Patent
Hu

(10) Patent No.: US 10,311,784 B2
(45) Date of Patent: Jun. 4, 2019

(54) PIXEL DRIVER CIRCUIT, DISPLAY DEVICE AND PIXEL DRIVING METHOD

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Zuquan Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/514,678

(22) PCT Filed: Jul. 13, 2016

(86) PCT No.: PCT/CN2016/089922
§ 371 (c)(1),
(2) Date: Mar. 27, 2017

(87) PCT Pub. No.: WO2017/156945
PCT Pub. Date: Sep. 21, 2017

(65) Prior Publication Data

US 2019/0005875 A1 Jan. 3, 2019

(30) Foreign Application Priority Data

Mar. 18, 2016 (CN) ..... 2016 1 0157872

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3208* (2013.01); *G09G 3/3225* (2013.01); *G09G 2300/0426* (2013.01)

(58) Field of Classification Search
CPC ..... G09G 3/12–3/14; G09G 3/30–3/3291
See application file for complete search history.

(56) References Cited

U.S. PATENT DOCUMENTS 6,859,193 B1 2/2005 Yumoto
2001/0019327 A1 9/2001 Kim et al.
(Continued)

FOREIGN PATENT DOCUMENTS

CN 1606057 A 4/2005
CN 102708786 A 10/2012
(Continued)

OTHER PUBLICATIONS

First Office Action for Chinese Application No. 201610157872.8 dated Aug. 28, 2017, 6 Pages.
(Continued)

*Primary Examiner* — Sanghyuk Park
(74) *Attorney, Agent, or Firm* — Brooks Kushman P.C.

(57) ABSTRACT

A pixel driver circuit includes a driving transistor T1 connected in series to a light-emitting element, a capacitor C, a first end of which is connected to a gate electrode of T1 and a second end of which is connected to a source electrode of T1, and a charging circuit at least including a current source and configured to charge C at a charging stage. Within at least a part of time period of the charging stage, an intensity of a charging current for charging C is greater than an intensity of a target current, and after the charging stage, a voltage difference across C is equal to a target voltage difference. When the light-emitting element emits light at a preset brightness value at a light-emitting stage, the target
(Continued)

voltage difference is a gate-to-source voltage difference of T1 and the target current is a current flowing through T1.

20 Claims, 8 Drawing Sheets

(51) Int. Cl.
*G09G 3/3208* (2016.01)
*G09G 3/3225* (2016.01)

(56) References Cited

U.S. PATENT DOCUMENTS

2004/0048069 A1* 3/2004 Yamada ..... G09G 3/325 428/411.1
2004/0178407 A1* 9/2004 Lin ..... G09G 3/325 257/40
2008/0225022 A1* 9/2008 Kim ..... G09G 3/3225 345/204
2013/0134897 A1 5/2013 Tan et al.
2013/0147386 A1* 6/2013 Tan ..... H05B 33/0842 315/226
2014/0117862 A1 5/2014 Qing et al.
2016/0240127 A1 8/2016 Duan et al.

FOREIGN PATENT DOCUMENTS

CN 102708787 A 10/2012
CN 102708798 A 10/2012
CN 103280183 A 9/2013
CN 105632405 A 6/2016
KR 20070000831 A 1/2007
KR 101137849 B1 4/2012
WO 0106484 A1 1/2001
WO 200106484 A1 1/2001

OTHER PUBLICATIONS

International Search Report and Written Opinion for Application No. PCT/CN2016/089922, dated Jan. 12, 2016, 12 Pages.

* cited by examiner

PIXEL DRIVER CIRCUIT, DISPLAY DEVICE AND PIXEL DRIVING METHOD

CROSS-REFERENCE TO RELATED APPLICATIONS

This application is the U.S. national phase of PCT Application No. PCT/CN2016/089922 filed on Jul. 13, 2016, which claims priority to Chinese Patent Application No. 201610157872.8 filed on Mar. 18, 2016, the disclosures of which are incorporated in their entirety by reference herein.

TECHNICAL FIELD

The present disclosure relates to the field of pixel driving technology, in particular to a pixel driver circuit, a display device and a pixel driving method.

BACKGROUND

In the related art, for a pixel driver circuit which controls a working current through a current source, a turning-on degree of a driving transistor is usually controlled by a capacitor structure at a display stage. After a grayscale value of a subpixel has been determined, a target current $I_{target}$ flowing through the driving transistor is determined too. However, at a charging stage, a current generated by the current source is equal to $I_{target}$. In this way, it is impossible for the driver circuit to be applied to a display panel having a high resolution. In addition, in the case that this driver circuit is applied to a display panel having a low resolution, an effective display time period is reduced as well as a display effect may be deteriorated.

SUMMARY

An object of the present disclosure is to provide a pixel driver circuit, a display device and a pixel driving method, so as to improve the display effect.

In one aspect, the present disclosure provides in some embodiments a pixel driver circuit for driving a light-emitting element in a pixel structure, including: a driving transistor T1 connected in series to the light-emitting element, a drain electrode of which is connected to a first power source signal input end VDD; a capacitor C, a first end of which is connected to a gate electrode of the driving transistor T1, and a second end of which is connected to a source electrode of the driving transistor T1; and a charging circuit at least including a current source and configured to charge the capacitor C at a charging stage. Within at least a part of time period of the charging stage, an intensity of a charging current for charging the capacitor C is greater than an intensity of a target current, and after the charging stage, a voltage difference across the capacitor C is equal to a target voltage difference. The target voltage difference is a gate-to-source voltage difference of the driving transistor T1 in the case that the light-emitting element emits light at a preset brightness value at a light-emitting stage. The target current is a current flowing through the driving transistor T1 in the case that the light-emitting element emits the light at the preset brightness value at the light-emitting stage.

In a possible embodiment of the present disclosure, the charging circuit includes: at least one current control transistor T2 connected in parallel to the driving transistor T1, a gate electrode of which is connected to the first end of the capacitor C and a source electrode of which is connected to the second end of the capacitor C; the current source capable of generating a current at an intensity greater than the target current and arranged between a second power source signal input end VSS and a first common node N1 connected to the source electrode of the driving transistor T1, the source electrode of the current control transistor T2 and the second end of the capacitor C; and a control unit configured to control the current control transistor T2 and the current source to charge the capacitor C at the charging stage, and control the current control transistor T2 and the current source to stop charging the capacitor C at a display stage.

In a possible embodiment of the present disclosure, the control unit includes: a first switching unit configured to turned on at the charging stage so as to electrically connect the first power source signal input end VDD to the source electrode and a drain electrode of the current control transistor T2 to the first end of the capacitor C, and configured to be turned off at the light-emitting stage; and a second switching unit arranged between the second power source signal input end VSS and the first common node N1, connected in series to the current source, and configured to be turned on at the charging stage and turned off at the light-emitting stage.

In a possible embodiment of the present disclosure, the first switching unit includes a first thin film transistor (TFT) M1 configured to be turned on at the charging stage and turned off at the light-emitting stage, a drain electrode of which is connected to the first power source signal input end VDD, and a source electrode of which is connected to a second common node N2 connected to the drain electrode and the gate electrode of the current control transistor T2 and the first end of the capacitor C.

In a possible embodiment of the present disclosure, the first switching unit includes: a second TFT M2 configured to be turned on at the charging stage and turned off at the light-emitting stage, a drain electrode of which is connected to the first power source signal input end VDD, and a source electrode of which is connected to the drain electrode of the current control transistor T2; and a second TFT M3 configured to be turned on at the charging stage and turned off at the light-emitting stage, a drain electrode of which is connected to the first power source signal input end VDD, and a source electrode of which is connected to a third common node N3 connected to the gate electrode of the current control transistor T2 and the first end of the capacitor C.

In a possible embodiment of the present disclosure, the light-emitting element is arranged between the second power source signal input end VSS and the first common node N1. The pixel driver circuit further includes a third switching unit arranged between the second power source signal input end VSS and the first common node N1, connected in series to the light-emitting element, and configured to be turned off at the charging stage and turned on at the light-emitting stage.

In another aspect, the present disclosure provides in some embodiments a display device including at least one pixel structure including a light-emitting element. Each pixel structure further includes the above-mentioned pixel driver circuit, and the light-emitting element is connected to a source electrode or a drain electrode of a driving transistor of the pixel driver circuit.

In yet another aspect, the present disclosure provides in some embodiments a pixel driving method for driving a light-emitting element of a pixel structure which is connected in series to a driving transistor T1, including a charging step of, at a charging stage, charging a capacitor C, a first end of which is connected to a gate electrode of the driving transistor T1 and a second end of which is connected to a source electrode of the driving transistor T1. A drain electrode of the driving transistor T1 is connected to a first power source signal input end VDD. Within at least a part of time period of the charging stage, an intensity of a charging current for charging the capacitor C is greater than an intensity of a target current, and after the charging stage, a voltage difference across the capacitor C is equal to a target voltage difference. The target voltage difference is a gate-to-source voltage difference of the driving transistor T1 in the case that the light-emitting element emits light at a preset brightness value at a light-emitting stage. The target current is a current flowing through the driving transistor T1 in the case that the light-emitting element emits the light at the preset brightness value at the light-emitting stage.

In a possible embodiment of the present disclosure, the charging step includes a control step of, controlling at least one current control transistor T2 connected in parallel to the driving transistor T1, and a current source connected between a second power source signal input end VSS and a first common node N1, to charge the capacitor C at the charging stage and stop charging the capacitor (C) at the display stage. The current source is capable of generating a current having an intensity greater than that of the target current. The first common node N1 is connected to the source electrode of the driving transistor T1, a source electrode of the current control transistor T2 and the second end of the capacitor C.

In a possible embodiment of the present disclosure, the control step includes: a first control step of controlling a first switching unit, which is arranged among the first power source signal input end VDD, a gate electrode and the source electrode of the current control transistor T2 and the first end of the capacitor C, to be turned on at the charging stage and turned off at the light-emitting stage; and a second control step of controlling a second switching unit, which is connected in series to the current source and arranged between the second power source signal input end VSS and the first common node N1, to be turned on at the charging stage and turned off at the light-emitting stage.

In a possible embodiment of the present disclosure, the first control step includes controlling a first TFT M1, a drain electrode of which is connected to the first power source signal input end VDD and a source electrode of which is connected to a second common node N2, to be turned on at the charging stage and turned off at the light-emitting stage. The second common node N2 is connected to a drain electrode and the gate electrode of the current control transistor T2 and the first end of the capacitor C.

According to the embodiments of the present disclosure, the charging circuit is capable of maintaining the voltage difference across the capacitor that has been charged to be the target voltage difference, so it is able to ensure the light-emitting element to emit light at a preset brightness value. As compared with the related art where a charging current is equal to a working current, the charging current in the embodiments of the present disclosure is greater than the working current within at least a part of time period of the charging stage. Through the increased charging current, it is able to increase a charging speed, thereby to apply the scheme in the embodiments of the present disclosure to a display panel having a high resolution. In the case that the scheme is applied to a display panel having a low resolution, a charging time period may be reduced, so it is able to prolong a display time period and improve a display effect.

DETAILED DESCRIPTION

It is found by the inventor that there are the problems in the related art, which will be described hereinafter at first.

Figure 1:
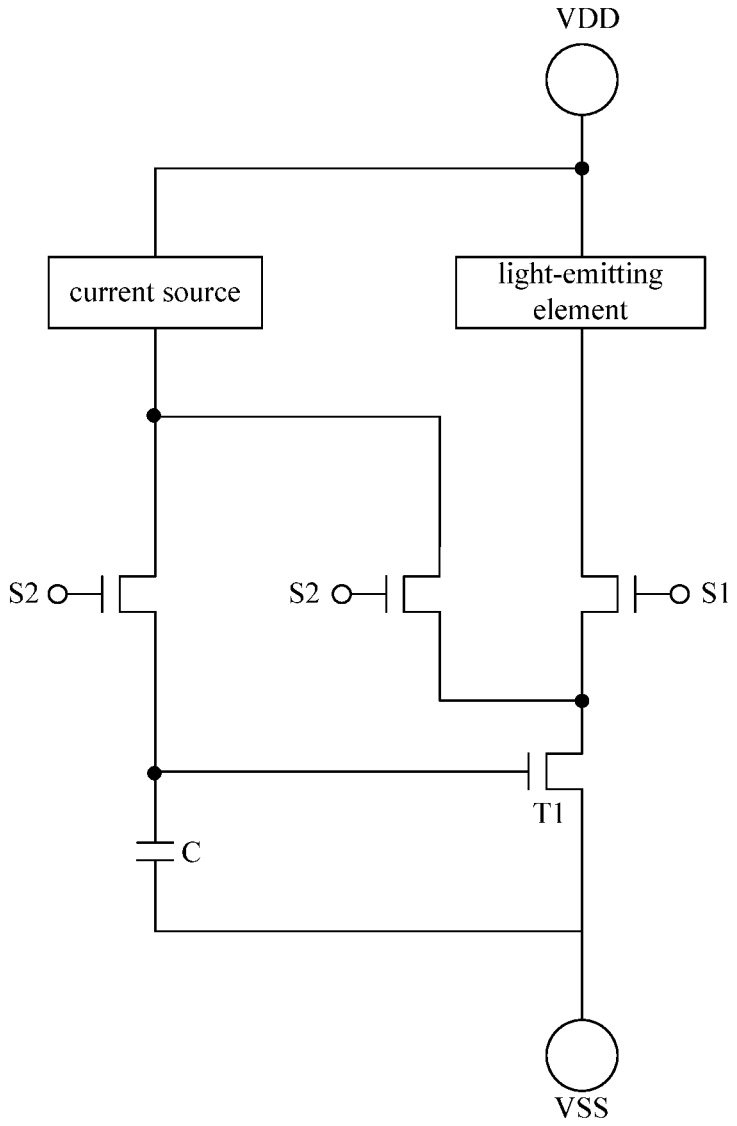
FIG. 1 is a circuit diagram of a driver circuit in the related art.

As shown in FIG. 1, which is a schematic view showing a pixel driver circuit in the related art, a working current is controlled by a current source, and at a display stage, a turning-on degree of a driving transistor T1 is controlled by a capacitor C. After a grayscale value of a subpixel has been determined, a target current $I_{target}$ flowing through the driving transistor may be determined too. The target current $I_{target}$, an non-adjustable parameters (including μ, W/L and Vth) and adjustable Vgs of the driving transistor may satisfy the following equation: $I_{target}=0.5\mu*(W/L)*(V_{gs}-V_{th})^2$, where μ represents a product of carrier mobility and an equivalent capacitance of the driving transistor, W/L represents a width-to-length ratio of the driving transistor, Vgs represents a gate-to-source voltage difference of the driving transistor, and Vth represents a threshold voltage of the driving transistor.

In order to ensure an organic light-emitting diode (OLED) to emit light as required at a light-emitting stage, a capacitor C needs to be charged, so as to enable a voltage difference across the capacitor to satisfy the following equation:

$$V_{gs}=\sqrt{2*I_{target}/[\mu*(W/L)]}+V_{th}.$$

As shown in FIG. 1, a first end of the capacitor is connected to a gate electrode of the driving transistor T1, and a second end thereof is connected to a source electrode of the driving transistor T1. The target current is generated by the current source, and through circuit design, the target current may be stabilized and then flow through the driving transistor. At this time, the capacitor may be charged by using the gate-to-source voltage difference of the driving transistor, so as to enable the voltage difference across the charged capacitor to be equal to a target voltage difference $\sqrt{2*I_{target}/[\mu*(W/L)]}+V_{th}$.

It can thus be found that, the current generated by the current source at the charging stage is equal to the target current $I_{target}$.

An operation procedure of the pixel driver circuit in the related art at the charging stage will be described hereinafter in conjunction with FIG. 1.

At the charging stage, a first control node S1 may output a low level signal and a second control node S2 may output a high level signal, so as to turn off a transistor controlled by the first control node S1 and turn on a transistor controlled by the second control node S2.

At the beginning of the charging stage, a voltage difference across the capacitor C is very small, so the driving transistor T1 is in an off state. At this time, all the current generated by the current source may flow through a path the capacitor C, so as to charge the capacitor C with a relatively large current (i.e., having a current intensity equal to that of $I_{target}$).

After a certain time period, the voltage difference across the capacitor may reach a threshold voltage of the driving transistor T1, and at this time, a channel may be formed in the driving transistor T1. A part of the current generated by the current source may by pass to a path including the driving transistor T1, so the current flowing through the path including the capacitor C may be weakened, i.e., smaller than $I_{target}$. With the elapse of time, the current flowing through the path including the capacitor C may be reduced gradually.

After another time period, a stable state may be achieved, and the voltage difference across the capacitor may be maintained at the target voltage difference. All the current generated by the current source at the charging stage may flow through the driving transistor, and an intensity of the current flowing through the path including the capacitor C may be 0.

It can thus be found that, the charging stage may include the following three sub-stages. At an initial sub-stage, the voltage difference across the capacitor C is smaller than the threshold voltage, and at this time, an intensity of the charging current is equal to an intensity of the working current $I_{target}$. At an intermediate sub-stage, the voltage difference across the capacitor C is greater than or equal to the threshold voltage, and at this time, the intensity of the charging current may be reduced gradually from a maximum value ($I_{target}$). At a stable sub-stage, the voltage difference across the capacitor C may be maintained at the target voltage difference, and the intensity of the charging current is approximately 0.

In other words, at the entire charging stage, for the charging circuit in FIG. 1, the intensity of the charging current flowing through the capacitor may be maintained at the maximum value ($I_{target}$) for a certain time period, then gradually reduced, and finally maintained at the stable state (at this time, the intensity of the current is approximately 0).

A charging efficiency of the capacitor depends on both a voltage and a current intensity of a charging signal. However, for the charging circuit in FIG. 1, the current intensity of the charging signal decreases gradually from $I_{target}$. In the case that $I_{target}$ is small, the current intensity of the charging current may be smaller than $I_{target}$, so the charging speed may be too small. For the display panel having a high resolution, a charging time allocated for each pixel is very limited, so it is impossible for the above-mentioned scheme to meet the requirement of the display panel having a high resolution. Even in the case that the scheme is applied to a display panel having a relative low resolution, an effective display time may be reduced and a display effect may be deteriorated.

In order to overcome the above defects found by the inventor, the present disclosure provides in some embodiments a pixel driver circuit, a display device and a pixel driving method, so as to charge the capacitor at a large charging current and shorten the charging time while meeting the requirement on the voltage difference across the capacitor, thereby to apply the schemes in the embodiments of the present disclosure to a display panel having a high resolution. In addition, even in the case that the schemes are applied to a display panel at a relative low resolution, it is able to improve a display effect.

In order to make the objects, the technical solutions and the advantages of the present disclosure more apparent, the present disclosure will be described hereinafter in conjunction with the drawings and embodiments.

Figure 2:
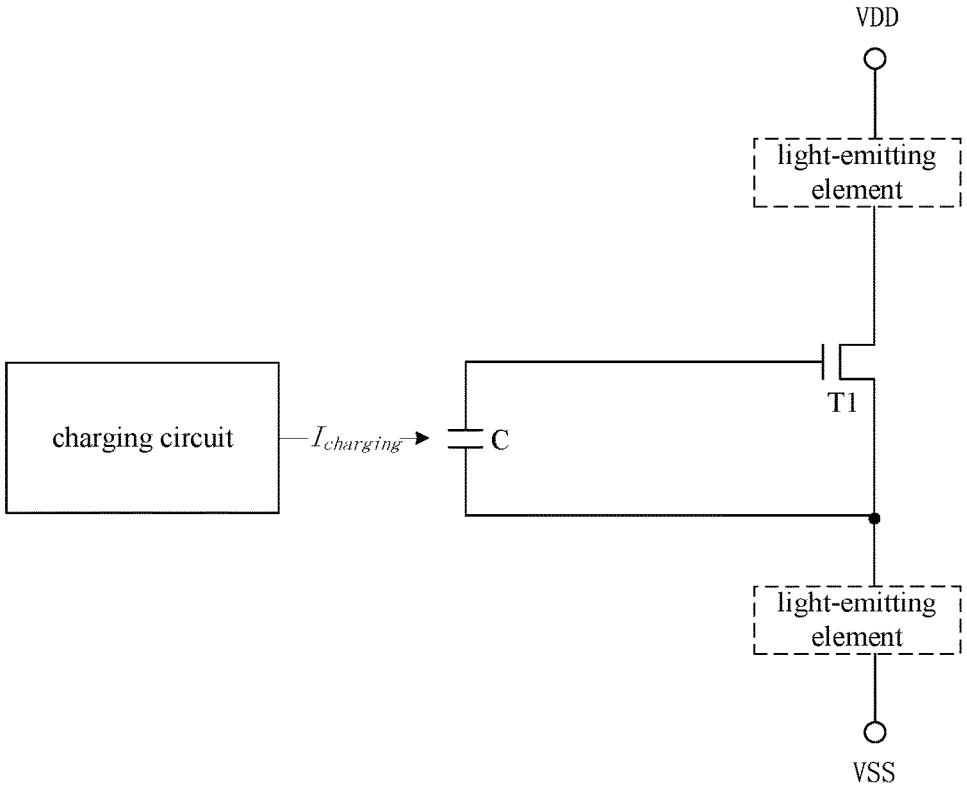
FIG. 2 is a schematic view showing a pixel driver circuit according to at least one embodiment of the present disclosure.

The present disclosure provides in some embodiments a pixel driver circuit for driving a light-emitting element of a pixel structure. As shown in FIG. 2, the pixel diver circuit includes a driving transistor T1 connected in series to the light-emitting element, a capacitor C and a charging circuit at least including a current source.

A drain electrode of the driving transistor T1 is connected, directly or indirectly, to a first power source signal input end VDD. In FIG. 2, the drain electrode of the driving transistor T1 may be directly connected to, or connected via the light-emitting element to, the first power source signal input end VDD.

In FIG. 2, dotted boxes are used to represent possible positions of the light-emitting element, rather than to show two light-emitting elements. Unless otherwise specified, in the subsequent drawings and description, the light-emitting element is arranged between a drain electrode of the driving transistor T1 and a second power source signal input end VSS.

A first end of the capacitor C is connected to a gate electrode of the driving transistor T1, and a second end thereof is connected to a source electrode of the driving transistor T1. The charging circuit is configured to charge the capacitor C at a charging stage. Within at least a time period of the charging stage, an intensity of a charging current for charging the capacitor C is greater than an intensity of a target current $I_{target}$, and after the charging stage, a voltage difference across the capacitor C is equal to a target voltage difference. The target voltage difference is a gate-to-source voltage difference of the driving transistor T1 in the case that the light-emitting element emits light at a preset brightness value at a light-emitting stage. The target current is a current flowing through the driving transistor T1 in the case that the light-emitting element emits the light at the preset brightness value at the light-emitting stage.

A charging speed for the capacitor C is closely related to the charging current. In the related art, the intensity of the charging current is smaller than that of the target current $I_{target}$. In the case that $I_{target}$ is very small (e.g., in the case that a target grayscale value corresponding to the pixel structure is very small), a very long charging time is required, so it is impossible to apply the pixel driver circuit to a display panel having a high resolution, or an effective display time may be reduced.

In the embodiments of the present disclosure, after the capacitor has been charged by the charging circuit, the voltage difference across the capacitor is equal to the target voltage difference, so as to enable the light-emitting element to emit light at a preset brightness value. As compared with the related art where the intensity of the charging current decreases from $I_{target}$, in the embodiments of the present disclosure, within a certain time period of the charging stage, the intensity of the charging current of the charging circuit is greater than the intensity of the target current $I_{target}$. In other words, in the embodiments of the present disclosure, the intensity of the charging current may decrease from a current greater than $I_{target}$, so as to increase the intensity of the charging current and reduce the charging time, thereby enable to apply the pixel driver circuit to the display panel having a high resolution. In the case that the pixel driver circuit is applied to the display panel at a low resolution, because the charging time is reduced, it is able to provide a longer display time within one frame, thereby to improve a display effect.

As shown in FIG. 1, in the related art, the current generated by the current source may flow through two branches at the charging stage, i.e., the branch including the driving transistor T1 and the branch including the capacitor C. Finally, all the current generated by the current source may flow through the branch including the driving transistor T1. Because the capacitor needs to be charged, the intensity of the current generated by the current source must be equal to that of the target current $I_{target}$.

However, in the embodiments of the present disclosure, the intensity of the current generated by the current source is greater than that of the target current $I_{target}$, and a current control transistor T2 connected in series to the driving transistor T1 is provided. A connection mode between the current control transistor T2 and the capacitor is identical to that between the driving transistor and the capacitor. At a latter half of the charging stage, a part of the current generated by the current source that is larger than the target current $I_{target}$ may flow through the current control transistor T2.

At an initial charging stage, the voltage difference across the capacitor is relatively small, so the driving transistor T1 and the current control transistor T2 are both in the off state. At this time, the current generated by the current source whose intensity is greater than that of the target current $I_{target}$ may flow through the branch including the capacitor C, so as to charge the capacitor with a relative large current.

The present disclosure further provides in some embodiments another pixel driver circuit for driving a light-emitting element of a pixel structure. The pixel driver circuit includes a driving transistor T1 connected in series to the light-emitting element, a capacitor C and a charging circuit. A drain electrode of the driving transistor T1 is connected to a first power source signal input end VDD. A first end of the capacitor C is connected to a gate electrode of the driving transistor T1, and a second end thereof is connected to a source electrode of the driving transistor T1.

Figure 3:
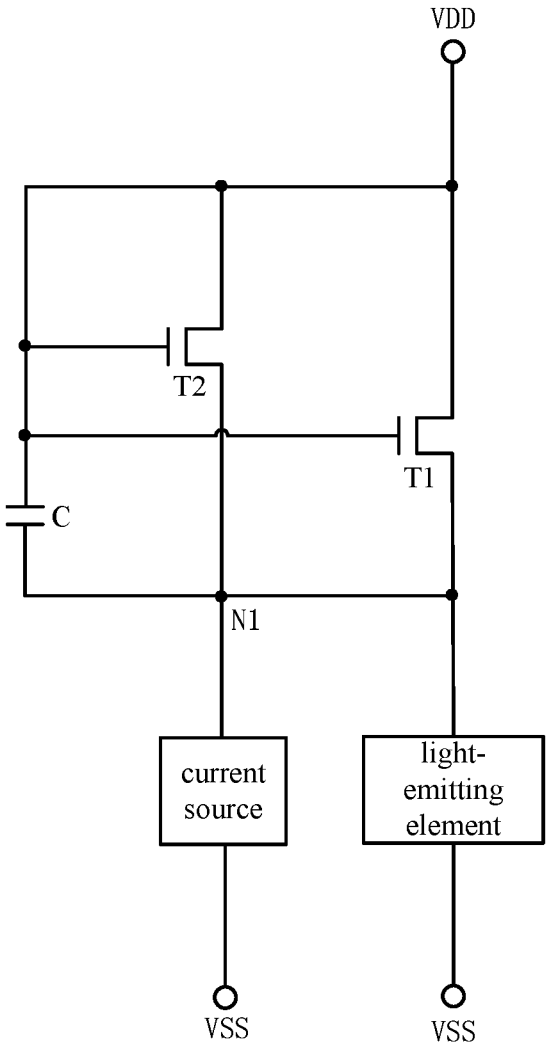
FIG. 3 is a schematic view showing a charging circuit of the pixel driver circuit according to at least one embodiment of the present disclosure.

As shown in FIG. 3, the charging circuit includes at least one current controlled transistor T2 connected in series to the driving transistor T1, a current source configured to generate a current whose intensity is greater than that of a target current $I_{target}$, and a control unit (not shown).

A gate electrode of the current control transistor T2 is connected to the first end of the capacitor C, and a source electrode thereof is connected to the second end of the capacitor C.

The current source is arranged between a second power source signal input end VSS and a first common node N1 which is connected to the source electrode of the driving transistor T1, the source electrode of the current control transistor T2 and the second end of the capacitor C.

The control unit is configured to control the current control transistor T2 and the current source to charge the capacitor C at a charging stage, and control the current control transistor T2 and the current source to stop charging the capacitor C at a display stage.

An operation procedure of the charging circuit will be described hereinafter in conjunction with FIG. 3.

At the beginning of the charging stage, a voltage difference across the capacitor C is very small, so the driving transistor T1 and the current control transistor T2 are both in an off state. At this time, all the current generated by the current source may flow through a path including the capacitor C, so as to charge the capacitor C with a relative large current (an intensity of which is greater than that of the target current $I_{target}$).

After a certain time period, the voltage difference across the capacitor may be equal to a threshold voltage of the driving transistor T1 and/or the current control transistor T2. At this time, a channel may be formed in the driving transistor T1 and/or the current control transistor T2, and a part of the current generated by the current source may flow through a path including the driving transistor T1 and/or the current control transistor T2, so as to reduce the current flowing through the path including the capacitor C. Along with the elapse of time, the intensity of the current flowing through the path including the capacitor C may decrease gradually.

After a certain time period again, a stable state may be achieved, and the voltage difference across the capacitor may be maintained at a target voltage difference. All the current generated by the current source at the charging stage may flow through the driving transistor T1 and the current control transistor T2, and the intensity of the current flowing through the path including the capacitor C may be 0.

It can thus be found that, the charging stage may also include the following three sub-stages. At an initial sub-stage, the voltage difference across the capacitor C is relatively small, and at this time, the intensity of the charging current is equal to the intensity of the current generated by the current source and greater than the intensity of the target current $I_{target}$. At an intermediate sub-stage, the voltage difference across the capacitor C may increase gradually, and at this time, the intensity of the charging current may be reduced gradually from a maximum value (the intensity of the current generated by the current source). At a stable sub-stage, the voltage difference across the capacitor C may be maintained at the target voltage difference, and the intensity of the charging current is approximately 0.

As compared with the related art, for the pixel driver circuit in the embodiments of the present disclosure, the capacitor may be charged with the charging current having a larger intensity at the initial sub-stage, so as to reduce the duration of the initial sub-stage.

At the intermediate sub-stage, the intensity of the charging current may gradually decrease in the related art and the embodiments of the present disclosure. However, in the embodiments of the present disclosure, the intensity of the charging current may decrease from a larger value (the intensity of the current generated by the current source), so it is able for the charging circuit in the embodiments of the present disclosure to provide the charging current at a larger average intensity, thereby to reduce the duration of the intermediate sub-stage.

In a word, it is able for the pixel driver circuit in the embodiments of the present disclosure to remarkably reduce the duration of the initial sub-stage and the intermediate sub-stage of the charging stage, thereby to reduce the charging time and enable to apply the pixel driver circuit to a display panel having a high resolution. In the case that the pixel driver circuit is applied to a display panel having a low resolution, due to the reduction of the charging time, it is able to prolong a display time within one frame, thereby to improve a display effect.

The above description is given by taking one current control transistor T2 as an example. It should be appreciated that, the more the current control transistors are, the larger the current capable of being outputted by the current source and the larger the charging speed are.

In a possible embodiment of the present disclosure, the control unit needs to control the current control transistor T2 and the current source to charge the capacitor C at the charging stage, and control the current control transistor T2 and the current source to stop charging the capacitor C at the display stage.

Figure 4:
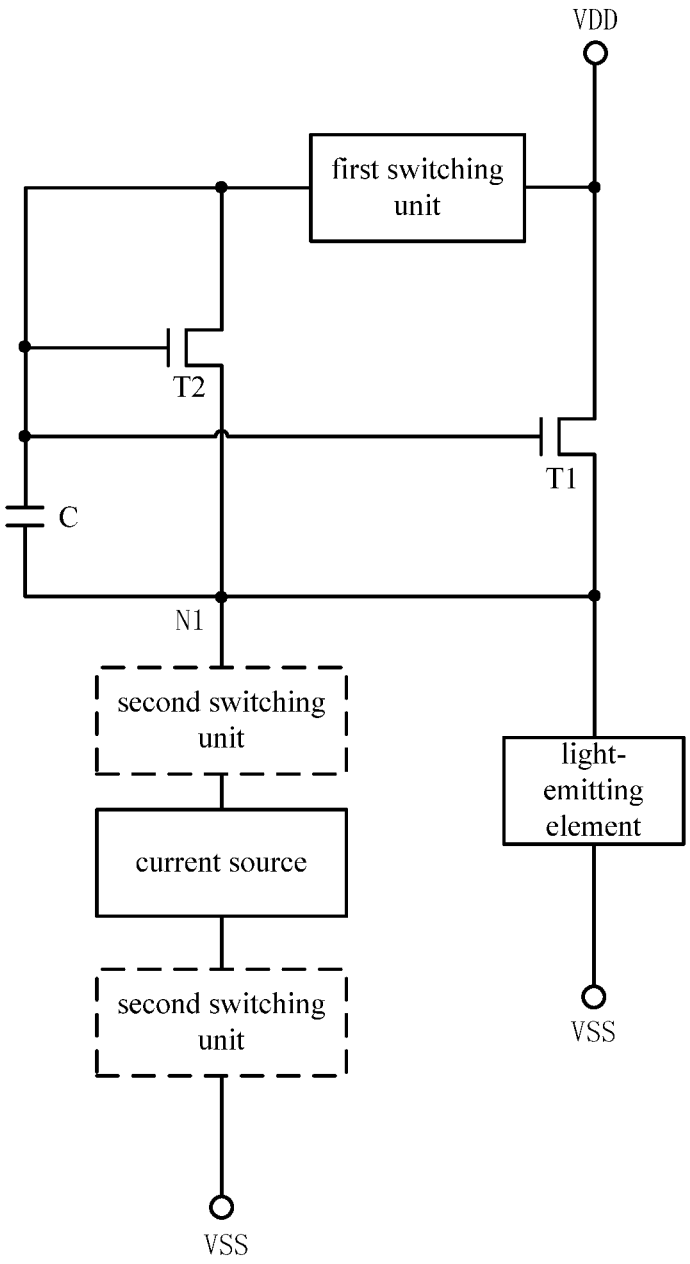
FIG. 4 is a schematic view showing a control unit of the pixel driver circuit according to at least one embodiment of the present disclosure.

In a possible embodiment of the present disclosure, two switching units may be provided so as to control the current control transistor T2 and the current source respectively. As shown in FIG. 4, the control unit includes a first switching unit and a second switching unit.

The first switching unit is configured to be turned on at the charging stage so as to electrically connect the first power source signal input end VDD to the gate electrode and the drain electrode of the current control driving transistor T2 and the first end of the capacitor C, and turned off at the light-emitting stage. The second switching unit is arranged between the second power source signal input end VSS and the first common node N1, connected in series to the current source, and configured to be turned on at the charging stage and turned off at the light-emitting stage.

As shown in FIG. 4, the dotted boxes represent that the second switching unit may be arranged at an end of the current source adjacent to, or away from, the second power source signal input end VSS.

In the embodiments of the present disclosure, the first switching unit may include one or two TFTs.

Figure 5:
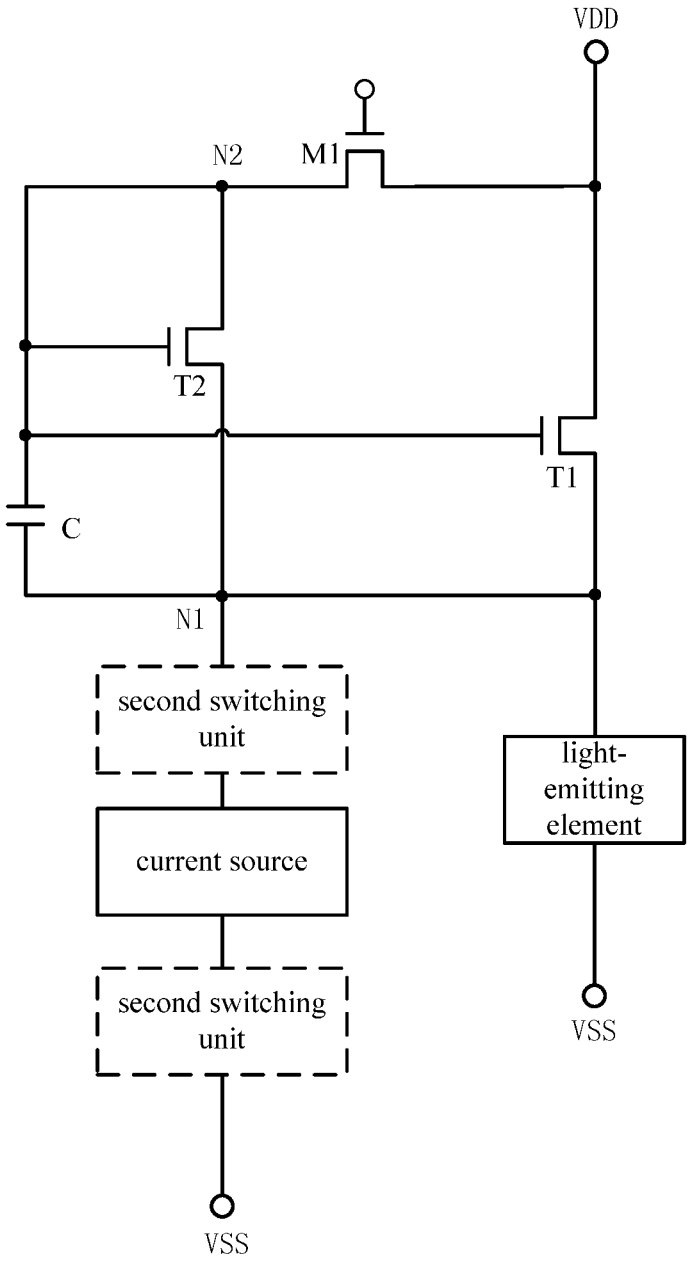
FIG. 5 is a schematic view showing a first switching unit according to at least one embodiment of the present disclosure.

As shown in FIG. 5, when the first switching unit includes one TFT, the first switching unit includes a first TFT M1 which is configured to be turned on at the charging stage and turned off at the light-emitting stage. A drain electrode of the first TFT M1 is connected to the first power source signal input end VDD, and a source electrode thereof is connected to the second common node N2 which is connected to the drain electrode and the gate electrode of the current control transistor T2 and the first end of the capacitor C.

Figure 6:
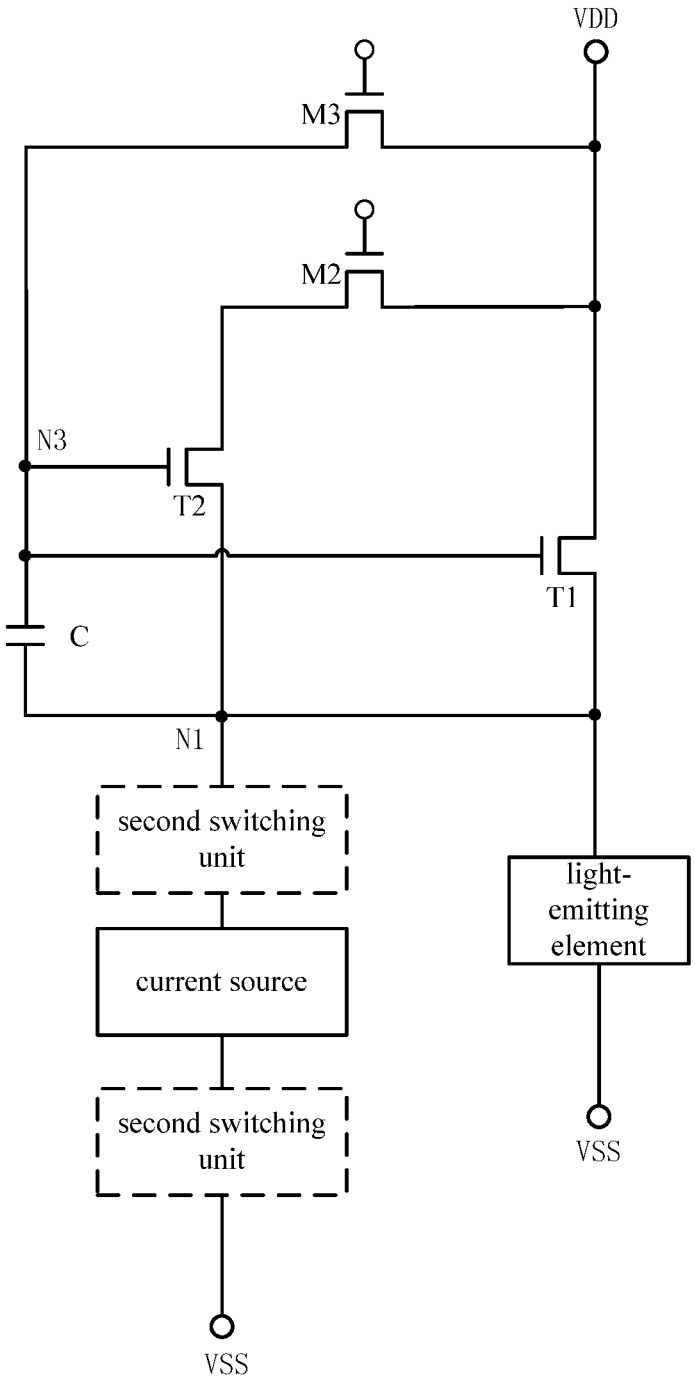
FIG. 6 is another schematic view showing the first switching unit according to at least one embodiment of the present disclosure.

As shown in FIG. 6, when the first switching unit includes two TFTs, the first switching unit includes a second TFT M2 and a third TFT M3. The second TFT M2 is configured to be turned on at the charging stage and turned off at the light-emitting stage. A drain electrode of the second TFT M2 is connected to the first power source signal input end VDD, and a source electrode thereof is connected to the drain electrode of the current control transistor T2. The third TFT M3 is configured to be turned on at the charging stage and turned off at the light-emitting stage. A drain electrode of the third TFT M3 is connected to the first power source signal input end VDD, and a source electrode thereof is connected to a third common node N3 which is connected to the gate electrode of the current control transistor T2 and the first end of the capacitor C.

In the embodiments of the present disclosure, the light-emitting element may be arranged between the drain electrode of the driving transistor T1 and the first power source signal input end VDD, or between the source electrode of the driving transistor T1 and the second power source signal input end VSS.

Figure 7:
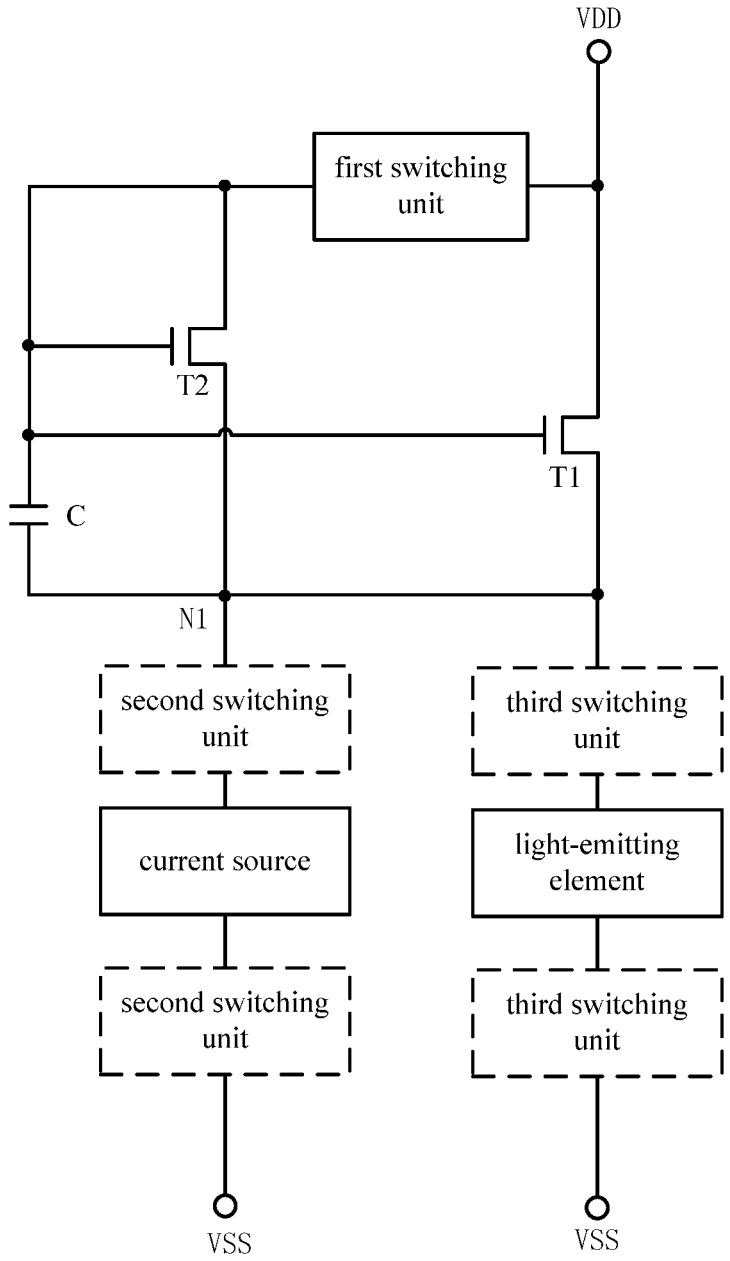
FIG. 7 is another schematic view showing the pixel driver circuit according to at least one embodiment of the present disclosure.

In the case that the light-emitting element is arranged between the second power source signal input end VSS and the first common node N1, as shown in FIG. 7, the pixel driver circuit in some embodiments of the present disclosure may further include a third switching unit, so as to ensure the light-emitting element to emit light at the preset brightness value at the charging stage. The third switching unit is arranged between the second power source signal input end VSS and the first common node N1, connected in series to the light-emitting element, and configured to be turned off at the charging stage and turned on at the light-emitting stage.

As shown in FIG. 7, the dotted boxes represent that the third switching unit may be arranged at an end of the light-emitting element adjacent to, or away from, the second power source signal input end VSS.

In the case that the light-emitting element is arranged between the drain electrode of the driving transistor T1 and the first power source signal input end VDD, an additional fourth switching unit needs to be provided. The fourth switching unit is connected in series to the light-emitting element, and configured to be turned on at the charging stage and turned off at the light-emitting stage.

An operation procedure of the pixel driver circuit will be described hereinafter by taking a circuit where the first, second and third switching units are all N-type TFTs as an example.

Figure 8:
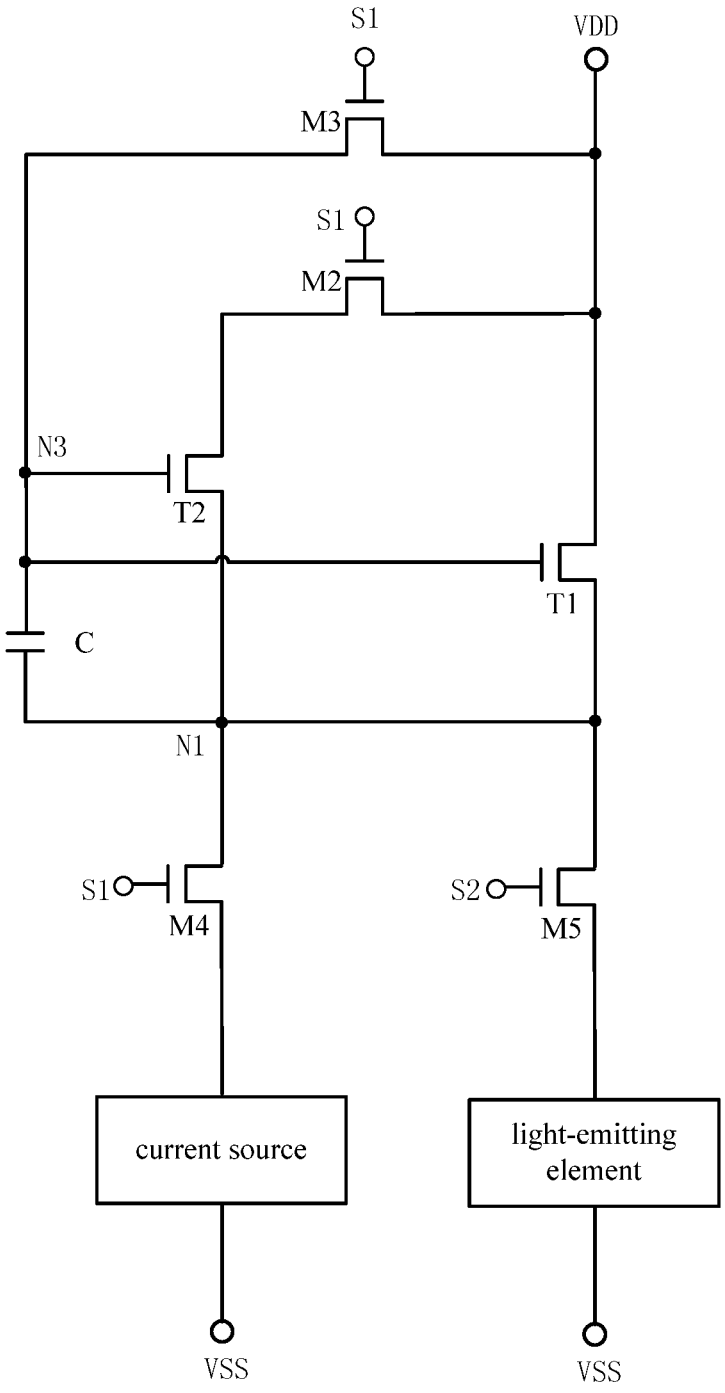
FIG. 8 is a schematic view showing a switching unit, which is implemented by N-type TFTs, according to one embodiment of the present disclosure.

As shown in FIG. 8, at the charging stage, a first control node S1 may output a high level signal and a second control node S2 may output a low level signal, so the second TFT M2, the second TFT M3 and a fourth TFT M4 which are controlled by the first control node S1 may be each in an on state, and a fifth TFT M5 controlled by the second control node S2 may be in an off state.

At an initial sub-stage of the charging stage, both the driving transistor T1 and the current control transistor T2 are in the off state, so all the current generated by the current source may flow through the capacitor C. At this time, the capacitor C may be charged with a large charging current, until T1 and/or T2 are turned on due to the voltage difference across the capacitor C.

In the case that a threshold voltage of the driving transistor T1 is different from that of the current control transistor T2, channels may be formed sequentially in the driving transistor T1 and the current control transistor T2. In the case that the threshold voltage of the driving transistor T1 is identical to that of the current control transistor T2, the channels may be formed in the driving transistor T1 and the current control transistor T2 simultaneously.

After the formation of the channels in the driving transistor T1 and the current control transistor T2, the voltage difference across the capacitor C may increase continuously. At this time, an intensity $I_1$ of the current flowing through the driving transistor T1 and an intensity $I_2$ of the current flowing through the current control transistor T2 may be calculated using the following equations: $I_1=0.5\mu_1*(W_1/L_1)*(V_{gs}-V_{th1})^2$, and $I_2=0.5\mu_2*(W_2/L_2)*(V_{gs}-V_{th2})^2$, where $\mu_1$ represents a product of carrier mobility of the driving transistor T1 and an equivalent capacitance of the driving transistor T1, $\mu^2$ represents a product of carrier mobility of the current control transistor T2 and an equivalent capacitance of the current control transistor T2, $W_1/L_1$ represents a width-to-length ratio of the driving transistor T1, $W_2/L_2$ represents a width-to-length ratio of the current control transistor T2, $V_{gs}$ represents a gate-to-source voltage difference between the driving transistor T1 and the current control transistor T2, i.e., the voltage difference across the capacitor C, $V_{th1}$ represents a threshold voltage of the driving transistor T1, and $V_{th2}$ represents a threshold voltage of the current control transistor T2.

In the case that the voltage different across the capacitor C increases continuously to a target voltage difference V, a stable state may be achieved. At this time, an intensity $I_1$ of the current flowing through the driving transistor T1 and an intensity $I_2$ of the current flowing through the current control transistor T2 may be calculated using the following equations: $I_1=0.5\mu_1*(W_1/L_1)*(V_{target}-V_{th1})^2$, and $I_2=0.5\mu_2*(W_2/L_2)*(V_{target}-V_{th2})^2$.

After the current control transistor T2 has been determined, it is able to calculate the intensity $I_2$ of the stable current flowing through the current control transistor T2. The intensity $I_1$ depends on a display brightness value of the light-emitting element within a current frame. Hence, the intensity of the current generated by the current source within the current frame may be a sum of the intensity $I_1$ and the intensity $I_2$ at a stable state.

At the light-emitting stage, the first control node S1 may output a low level signal and the second control node S2 may output a high level signal, so the second TFT M2, the third TFT M3 and the fourth TFT M4 which are controlled by the first control node S1 may be each in the off state, and the fifth TFT M5 controlled by the second control node S2 may be in the on state.

Due to maintenance capability of the capacitor C, the driving transistor T1 and the current control transistor T2 may be maintained in their respective states. Because the TFT M2 is in the off state, no current flows through the current control transistor T2. At this time, the driving transistor T1 may be in the on state, and the current flowing through the driving transistor T1 may be calculated using the following equation: $I_1=0.5\mu_1*(W_1/L_1)*(V_{target}-V_{th1})^2$.

Before the next frame, the above-mentioned state may be maintained, so the light-emitting element may emit light in a stable manner.

In the embodiments of the present disclosure, the light-emitting element may be any light-emitting unit driven by a current, e.g., an OLED.

In addition, in the embodiments of the present disclosure, the current generated by the current source may flow through the circuits connected in parallel to each other, so as to ensure that the current flowing through the driving transistor is just the target current. However, as mentioned above, regardless of the intensity of the current initially generated by the current source, the current may not flow through the branch including driving transistor before the capacitor is charged to a certain extent (i.e., before the voltage difference across the capacitor is equal to the threshold voltage of the driving transistor).

Hence, in some embodiments of the present disclosure, at the initial sub-stage of the charging stage, the current having an intensity greater than that of the target current $I_{target}$ may be generated by the current source, and at the intermediate sub-stage of the charging stage, i.e., after the voltage difference across the capacitor is greater than the threshold voltage of the driving transistor, the current having an intensity identical to that of the target current $I_{target}$ may be generated by the current source.

In this case, as compared with the related art, it is able for the pixel driver circuit in the embodiments of the present disclosure to remarkably reduce the duration of the initial sub-stage and reduce the charging time, and thus it is able to apply the pixel driver circuit to a display panel having a high resolution. In the case that the pixel driver circuit is applied to a display panel having a low resolution, due to the reduction in the charging time, it is able to prolong a display time within one frame, thereby to improve a display effect.

The present disclosure further provides in some embodiments a display device including at least one pixel structure. Each pixel structure includes a light-emitting element and the above-mentioned pixel driver circuit. The light-emitting element is connected to the source electrode or the drain electrode of the driving transistor of the pixel driver circuit.

The present disclosure further provides in some embodiments a pixel driving method for driving the light-emitting element of the pixel structure which is connected in series to the driving transistor T1. The pixel driving method includes a charging step of, at the charging stage, controlling the charging circuit at least including a current source to charge the capacitor C, a first end of which is connected to the gate electrode of the driving transistor T1 and a second end of which is connected to the source electrode of the driving transistor T1. During the charging state, within at least a part time period of the charging stage, a current intensity of the charging current for charging the capacitor C is greater than a current intensity of the target current, and after the charging stage, a voltage difference across the capacitor C is equal to the target voltage difference. The target voltage difference is a gate-to-source voltage difference of the driving transistor T1 in the case that the light-emitting element emits light at a preset brightness value at the light-emitting stage. The target current is a current flowing through the driving transistor T1 in the case that the light-emitting element emits the light at the preset brightness value at the light-emitting stage.

In a possible embodiment of the present disclosure, the charging step includes a control step of, controlling at least one current control transistor T2 connected in series to the driving transistor T1, and the current source connected between the second power source signal input end VSS and the first common node N1, to charge the capacitor C at the charging stage and stop charging the capacitor C at the display stage. The current source generates a current having an intensity greater than that of the target current. The first common node N1 is connected to the source electrode of the driving transistor T1, a source electrode of the current control transistor T2 and the second end of the capacitor C.

In a possible embodiment of the present disclosure, the control step includes: a first control step of controlling the first switching unit, which is arranged among the first power source signal input end VDD, the gate electrode and the source electrode of the current control transistor T2, and the first end of the capacitor C, to be turned on at the charging stage and turned off at the light-emitting stage; and a second control step of controlling the second switching unit, which is connected in series to the current source and arranged between the second power source signal input end VSS and the first common node N1, to be turned on at the charging stage and turned off at the light-emitting stage.

In a possible embodiment of the present disclosure, the first control step includes controlling the first TFT M1, a drain electrode of which is connected to the first power source signal input end VDD and a source electrode of which is connected to the second common node N2, to be turned on at the charging stage and turned off at the light-emitting stage. The second common node N2 is connected to the drain electrode and the gate electrode of the current control transistor T2 and the first end of the capacitor C.

All the transistors adopted in the embodiments of the present disclosure may be TFTs, or field effect transistors (FETs) or any other diode having a similar characteristic. A source electrode and a drain electrode of each transistor are provided symmetrically, so they may be replaced with each other.

The above description is given by taking an N-type TFT as an example, and at this time, in the case that a high level is applied to its gate electrode, its source electrode may be electrically connected to its drain electrode. Of course, a P-type TFT may also be used, and at this time, in the case that a low level is applied to its gate electrode, its source electrode may be electrically connected to its drain electrode.

The above are merely the preferred embodiments of the present disclosure. Obviously, a person skilled in the art may make further modifications and improvements without departing from the spirit of the present disclosure, and these modifications and improvements shall also fall within the scope of the present disclosure.

What is claimed is:

1. A pixel driver circuit for driving a light-emitting element of a pixel structure, comprising:

a driving transistor (T1) connected in series to the light-emitting element, a drain electrode of the driving transistor (T1) is connected to a first power source signal input end (VDD);

a capacitor (C), a first end of the capacitor (C) is connected to a gate electrode of the driving transistor (T1), and a second end of the capacitor (C) is connected to a source electrode of the driving transistor (T1); and a charging circuit at least including a current source and configured to charge the capacitor (C) at a charging stage, wherein within at least a part of time period of the charging stage, an intensity of a charging current for charging the capacitor (C) is greater than an intensity of a target current, and after the charging stage, a voltage difference across the capacitor (C) is equal to a target voltage difference;

the target voltage difference is a gate-to-source voltage difference of the driving transistor T1 when the light-emitting element emits light at a preset brightness value at a light-emitting stage; and the target current is a current flowing through the driving transistor T1 when the light-emitting element emits the light at the preset brightness value at the light-emitting stage.

2. The pixel driver circuit according to claim 1, wherein the charging circuit comprises:

at least one current control transistor (T2) connected in parallel to the driving transistor (T1), a gate electrode of the current control transistor (T2) is connected to the first end of the capacitor (C) and a source electrode of the current control transistor (T2) is connected to the second end of the capacitor (C);

the current source configured to generate a current having an intensity greater than an intensity of the target current and arranged between a second power source signal input end (VSS) and a first common node (N1) that are connected to the source electrode of the driving transistor (T1), the source electrode of the current control transistor (T2) and the second end of the capacitor (C); and a control unit configured to control the current control transistor (T2) and the current source to charge the capacitor (C) at the charging stage, and control the current control transistor (T2) and the current source to stop charging the capacitor (C) at a display stage.

3. The pixel driver circuit according to claim 2, wherein the control unit comprises a first switching unit and a second switching unit, wherein:

the first switching unit is turned on at the charging stage to electrically connect the first power source signal input end (VDD), the source electrode and a drain electrode of the current control transistor (T2) and the first end of the capacitor (C), and configured to be turned off at the light-emitting stage; and the second switching unit is arranged between the second power source signal input end (VSS) and the first common node (N1), connected in series to the current source, and configured to be turned on at the charging stage and turned off at the light-emitting stage.

4. The pixel driver circuit according to claim 3, wherein the first switching unit comprises a first thin film transistor (TFT) (M1), a drain electrode of the first TFT (M1) is connected to the first power source signal input end (VDD), and a source electrode of the first TFT (M1) is connected to a second common node (N2) that is connected to the drain electrode and the gate electrode of the current control transistor (T2) and the first end of the capacitor (C), the first TFT (M1) is configured to be turned on at the charging stage and turned off at the light-emitting stage.

5. The pixel driver circuit according to claim 4, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

6. The pixel driver circuit according to claim 3, wherein the first switching unit comprises a second TFT (M2) and a third TFT (M3), wherein:

a drain electrode of the second TFT (M2) is connected to the first power source signal input end (VDD), and a source electrode of the second TFT (M2) is connected to the drain electrode of the current control transistor (T2), the second TFT (M2) is configured to be turned on at the charging stage and turned off at the light-emitting stage; and a drain electrode of the third TFT (M3) is connected to the first power source signal input end (VDD), and a source electrode of the third TFT (M3) is connected to a third common node (N3) that is connected to the gate electrode of the current control transistor (T2) and the first end of the capacitor (C), the third TFT (M3) configured to be turned on at the charging stage and turned off at the light-emitting stage.

7. The pixel driver circuit according to claim 6, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

8. The pixel driver circuit according to claim 3, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

9. The pixel driver circuit according to claim 2, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

10. The pixel driver circuit according to claim 1, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

11. A display device, comprising at least one pixel structure, wherein each pixel structure comprises a light-emitting element and the pixel driver circuit according to claim 1, and the light-emitting element is connected to the source electrode or drain electrode of the driving transistor of the pixel driver circuit.

12. The display device according to claim 11, wherein the charging circuit comprises:

at least one current control transistor (T2) connected in parallel to the driving transistor (T1), a gate electrode of the current control transistor (T2) is connected to the first end of the capacitor (C) and a source electrode of the current control transistor (T2) is connected to the second end of the capacitor (C);

the current source configured to generate a current having an intensity greater than an intensity of the target current and arranged between a second power source signal input end (VSS) and a first common node (N1) that are connected to the source electrode of the driving transistor (T1), the source electrode of the current control transistor (T2) and the second end of the capacitor (C); and a control unit configured to control the current control transistor (T2) and the current source to charge the capacitor (C) at the charging stage, and control the current control transistor (T2) and the current source to stop charging the capacitor (C) at a display stage.

13. The display device according to claim 12, wherein the control unit comprises a first switching unit and a second switching unit, wherein:

the first switching unit is turned on at the charging stage to electrically connect the first power source signal input end (VDD), the source electrode and a drain electrode of the current control transistor (T2) and the first end of the capacitor (C), and configured to be turned off at the light-emitting stage; and the second switching unit is arranged between the second power source signal input end (VSS) and the first common node (N1), connected in series to the current source, and configured to be turned on at the charging stage and turned off at the light-emitting stage.

14. The display device according to claim 13, wherein the first switching unit comprises a first thin film transistor (TFT) (M1), a drain electrode of the first TFT (M1) is connected to the first power source signal input end (VDD), and a source electrode of the first TFT (M1) is connected to a second common node (N2) that is connected to the drain electrode and the gate electrode of the current control transistor (T2) and the first end of the capacitor (C), the first TFT (M1) is configured to be turned on at the charging stage and turned off at the light-emitting stage.

15. The display device according to claim 13, wherein the first switching unit comprises a second TFT (M2) and a third TFT (M3), wherein:

a drain electrode of the second TFT (M2) is connected to the first power source signal input end (VDD), and a source electrode of the second TFT (M2) is connected to the drain electrode of the current control transistor (T2), the second TFT (M2) is configured to be turned on at the charging stage and turned off at the light-emitting stage; and a drain electrode of the third TFT (M3) is connected to the first power source signal input end (VDD), and a source electrode of the third TFT (M3) is connected to a third common node (N3) that is connected to the gate electrode of the current control transistor (T2) and the first end of the capacitor (C), the third TFT (M3) configured to be turned on at the charging stage and turned off at the light-emitting stage.

16. The display device according to claim 11, wherein the light-emitting element is arranged between the second power source signal input end (VSS) and the first common node (N1); and the pixel driver circuit further comprises a third switching unit arranged between the second power source signal input end (VSS) and the first common node (N1) that is connected to the source electrode of the driving transistor (T1), the source electrode of the current control transistor (T2) and the second end of the capacitor (C), the third switch unit is connected in series to the light-emitting element, and configured to be turned off at the charging stage and turned on at the light-emitting stage.

17. A pixel driving method for driving a light-emitting element of a pixel structure, the light-emitting element being connected in series to a driving transistor (T1), comprising a charging step of charging a capacitor (C) at a charging stage, wherein a first end of the capacitor (C) is connected to a gate electrode of the driving transistor (T1) and a second end of the capacitor (C) is connected to a source electrode of the driving transistor (T1), a drain electrode of the driving transistor (T1) is connected to a first power source signal input end (VDD);

within at least a part of time period of the charging stage, an intensity of a charging current for charging the capacitor (C) is greater than an intensity of a target current, and after the charging stage, a voltage difference across the capacitor (C) is equal to a target voltage difference;

the target voltage difference is a gate-to-source voltage difference of the driving transistor (T1) when the light-emitting element emits light at a preset brightness value at a light-emitting stage; and the target current is a current flowing through the driving transistor (T1) when the light-emitting element emits the light at the preset brightness value at the light-emitting stage.

18. The pixel driving method according to claim 17, wherein the charging step comprises a control step of, controlling at least one current control transistor (T2) connected in parallel to the driving transistor (T1), and a current source connected between a second power source signal input end (VSS) and a first common node (N1), to charge the capacitor (C) at the charging stage and stop charging the capacitor (C) at the display stage;

the current source is capable of generating a current having an intensity greater than an intensity of the target current; and the first common node (N1) is connected to the source electrode of the driving transistor (T1), a source electrode of the current control transistor (T2) and the second end of the capacitor (C).

19. The pixel driving method according to claim 18, wherein the control step comprises:

a first control step of controlling a first switching unit to be turned on at the charging stage and turned off at the light-emitting stage, the first switching unit being arranged among the first power source signal input end (VDD), a gate electrode and the drain electrode of the current control transistor (T2) and the first end of the capacitor (C); and a second control step of controlling a second switching unit to be turned on at the charging stage and turned off at the light-emitting stage, the second switching unit being connected in series to the current source and arranged between the second power source signal input end (VSS) and the first common node (N1).

20. The pixel driving method according to claim 19, wherein the first control step comprises controlling a first TFT (M1) to be turned on at the charging stage and turned off at the light-emitting stage, a drain electrode of the first TFT (M1) is connected to the first power source signal input end (VDD) and a source electrode of the first TFT (M1) is connected to a second common node (N2); and the second common node (N2) is connected to a drain electrode and the gate electrode of the current control transistor (T2) and the first end of the capacitor (C).

* * * * *